United States Patent [19]

Thompson, Sr.

[11] Patent Number: 4,823,478

[45] Date of Patent: Apr. 25, 1989

[54] FREEZE DRYER FOR UNATTENDED OPERATION

[75] Inventor: Taylor N. Thompson, Sr., Kingston, N.Y.

[73] Assignee: FTS Systems, Inc., Stone Ridge, N.Y.

[21] Appl. No.: 126,752

[22] Filed: Nov. 30, 1987

[51] Int. Cl.[4] ..... F26B 5/06

[52] U.S. Cl. ..... 34/5; 34/15; 34/92; 34/51

[58] Field of Search ..... 34/5, 15, 26, 30, 92, 34/51, 55

[56] References Cited

U.S. PATENT DOCUMENTS

| | | | |
|---|---|---|---|
| 4,017,983 | 4/1977 | Fraser | 34/5 |
| 4,547,977 | 10/1985 | Tenedini et al. | 34/92 X |
| 4,570,357 | 2/1986 | Kuboyama | 34/92 X |
| 4,619,054 | 10/1986 | Sato | 34/5 X |

*Primary Examiner*—Henry A. Bennet

*Attorney, Agent, or Firm*—Wallenstein Wagner Hattis & Strampel, Ltd.

[57] ABSTRACT

The freeze dryer device of the invention furnishes automatic operational, power outage and defrost control providing for an operator to perform other productive activities during operation of the freeze drying device. Upon initiation by the user, the operational control conditions the freeze drying device to receive bottles of frozen sample product to be freeze dried. Upon the drying device becoming properly conditioned in temperature and pressure, the device of the invention provides the user an indication to apply the sample bottles to the device. The power outage control protects the integrity of the samples applied to the drying device by sensing both temperature and pressure before returning to normal operation. If either temperature or pressure are above certain values after the power outage, the device of the invention stops normal operation by opening manifold chamber to atmospheric pressure while maintaining the refrigeration system operating. This protects the sample product from boiling up into the manifold while in a liquid state. The defrost control senses the absence or presence of ice on the condenser at the end of a defrost cycle. An absence of ice on the condenser causes the device to exit the defrosting cycle while presence of ice causes the device to reexecute the defrost cycle.

62 Claims, 6 Drawing Sheets

FREEZE DRYING
START UP
74
ACTIVATE DEVICE CONTROLLER
76
ENERGIZE REFRIGERATION SYSTEM
84
Tc < -40°C
NO
YES
86
TIME > 10 MIN
NO
YES
88
ALARM
92
ENERGIZE VACUUM SYSTEM
100
P < 500MT
NO
102
TIME > 10 MIN
NO
YES
104
ALARM
106
LIGHT ADD PRODUCT
110
MANUALLY ADD PRODUCT
112
Tc > -30°C
NO
YES
114
P > 500MT
NO
YES
116
ALARM

DEFROST

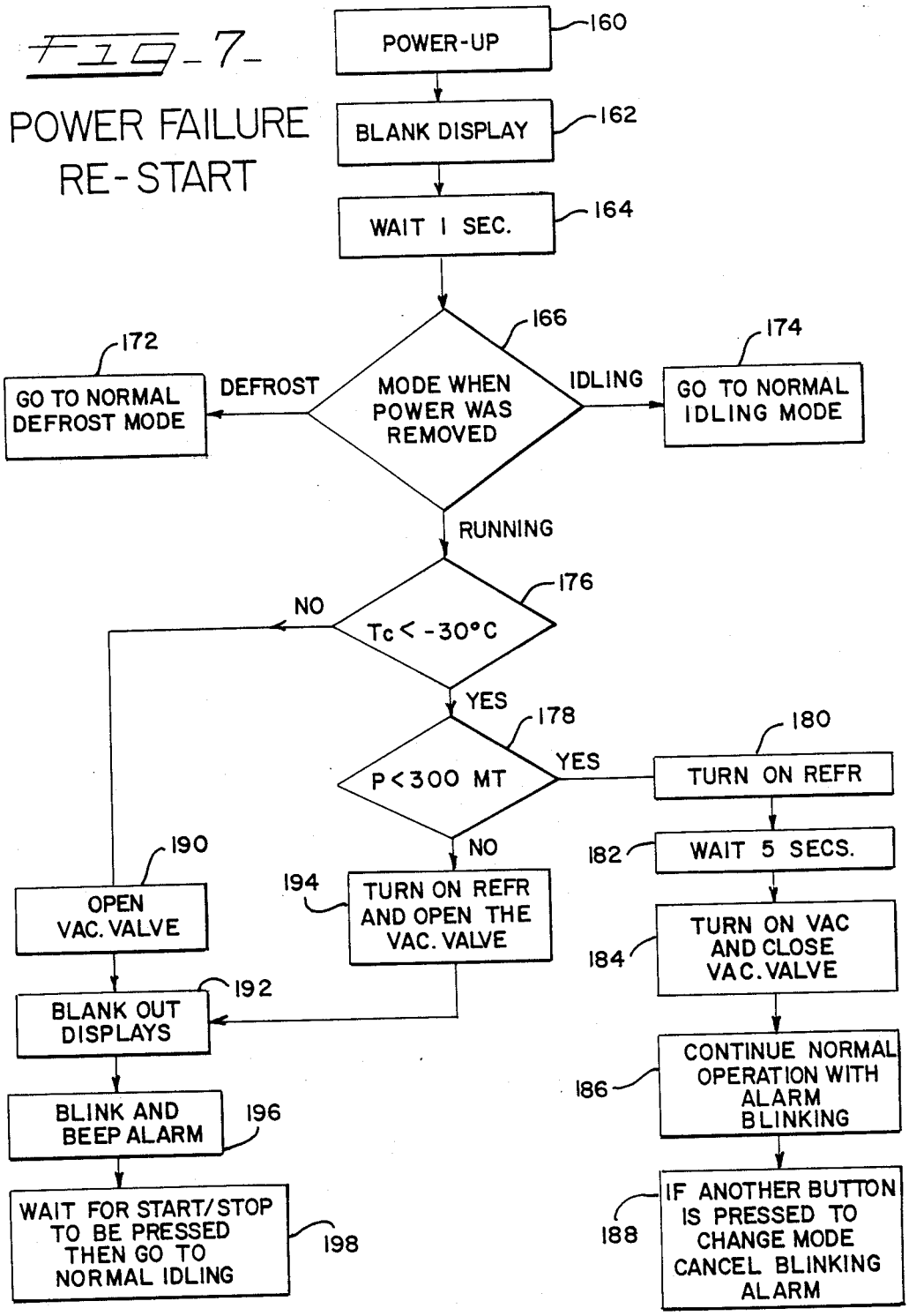
FIG-7-
POWER FAILURE RE-START
POWER-UP
160
BLANK DISPLAY
162
WAIT 1 SEC.
164
MODE WHEN POWER WAS REMOVED
166
DEFROST
IDLING
RUNNING
GO TO NORMAL DEFROST MODE
172
GO TO NORMAL IDLING MODE
174
Tc < -30°C
176
NO
YES
P<300 MT
178
YES
NO
TURN ON REFR
180
WAIT 5 SECS.
182
TURN ON VAC AND CLOSE VAC. VALVE
184
CONTINUE NORMAL OPERATION WITH ALARM BLINKING
186
IF ANOTHER BUTTON IS PRESSED TO CHANGE MODE CANCEL BLINKING ALARM
188
TURN ON REFR AND OPEN THE VAC. VALVE
194
OPEN VAC. VALVE
190
BLANK OUT DISPLAYS
192
BLINK AND BEEP ALARM
196
WAIT FOR START/STOP TO BE PRESSED THEN GO TO NORMAL IDLING
198

FREEZE DRYER FOR UNATTENDED OPERATION

CROSS REFERENCE TO RELATED APPLICATION

This invention relates to the invention disclosed and claimed in application Ser. No. 126,227, filed Nov. 30, 1988, in the name of Taylor N. Thompson, Sr. titled "Process and Device for Determining the End of the Primary Stage of the Freeze Drying Procedure" and assigned to the assignee of this application now U.S. Pat. No. 4,780,964, issued Nov. 1, 1988.

BACKGROUND OF THE INVENTION

This invention relates generally to freeze drying devices and the lyophilization procedures they implement and particularly relates to unattended operation of a freeze drying device that maintains the integrity of the samples to be dried during implementation of a freeze drying procedure.

Known freeze drying devices, such as in U.S. Pat. 4,017,983, assigned to the owner of this application require trained and experienced operators properly to effect lyophilization of a sample or samples; often the operators are the researchers themselves. The operators must exercise care in effecting the lyophilization process to protect and maintain the integrity of the samples that have been collected over periods as long as a year.

Attaching a sample bottle to the manifold of a device not ready to receive samples can result in the frozen sample melting and splattering over the interior of the manifold chamber and fouling the vacuum pump. In such a case, at least, the device must be warmed to room temperature and the manifold opened for cleaning. This results in a loss of use of the device, the cost of having trained and experienced people clean the device and possibly replace the vacuum pump, not to mention the enormous loss, in time and money, of the samples collected through diligent and hard work over a long period.

Often the lyophilization process takes an extended period to effect and so the device is left operating unattended overnight or over a weekend. Normally the device operates satisfactorily as long as the electrical power to the device continues uninterrupted. In the event of a power failure, however, the device simply returns to its set mode of operation upon return of the electricity. If the outage occurred for a short period, the return should cause no problem because the samples remain frozen and within their sample bottles.

An outage lasting a long time, however, will allow the samples to melt. When the device returns to its set mode of operation, the reduced pressure in the device causes the samples to boil up into the device and into the vacuum pump. This can result in a worse problem and loss of time and money than when samples are applied to the device before it is ready to receive them. Even if the samples have become substantially dried by the time of the outage, turning on the vacuum pump before the necessary reduction of temperature in the device can ruin the pump by pulling melted condesate or ice water into the pump.

After completion of a lyophilization process or the collection of a maximum amount of ice, the condenser in the manifold of the device must be defrosted. The operator turns off the vacuum pump, immediately turns a valve to open the vacuum chamber to the atmosphere and sets the refrigeration system to run in reverse for heating the condenser. Normally the heating of the condenser melts the ice in a short period and the water drains from the chamber. Even here problems can occur. The chamber must be opened to the atmosphere soon after turning off the pump; otherwise the pump oil backs up into the chamber, which then must be cleaned. If the refrigeration system becomes turned off, the ice will still melt, but over an extended period instead of quickly. If the device runs in the defrost mode after the ice melts and unattended for an extended period, such as over the weekend, the compressor of the refrigeration system experiences unnecessary wear.

The prior solutions to these and associated problems have been to provide competent and responsible operators to stand at the freeze drying devices while they are passing through the described cycles. This becomes an expensive solution when the operators could be performing other valuable and productive duties instead of waiting for the freeze dryer to complete a cycle. Further, the prior devices have failed to furnish a simple and positive indication to an operator of the time at which sequential operations, such as turning on the vacuum pump after the condenser reaches a desired low temperature, could or should be performed. This requires that the operators be well trained to effect the sequencing of the device and to know the symptoms of an improper condition, such as a cracked sample bottle preventing the re-establishment of the vacuum. Constructing and arranging the freeze dryer devices to operate unattended would free the researchers for other more important and productive activities.

SUMMARY OF THE INVENTION

In accordance with the invention a freeze dryer device includes a controller that senses the temperature of the condenser in the manifold and the pressure in the manifold chamber. The controller is constructed and arranged to condition the device, effect a lyophilization of samples, defrost the condenser and effect a proper power up sequence after a power outage, without operator supervision, after the operator manually selects and initiates the desired operation. The invention thus furnishes freeze drying device that safely operates unattended and that protects the valuable device and samples. Audible and visual signals indicate that the device needs the attention of an operator to continue so that the operator generally remains free to perform other duties until the actuation of such signal. The device of the invention frees much of the researcher's time previously required to operate the device enabling operators of lesser skill easily to operate the device without close supervision from a skilled researcher.

After operator initiation and preparatory to running a lyophilization, the controller sequences the operation of the refrigeration system and vacuum pump automatically to obtain the desired starting conditions. The controller also places a signal on a certain lead to audibly or visually indicate that the device stands ready to accept a sample bottle or bottles. After initiating operation of the device the operator thus can walkaway from the device to perform other duties while waiting for the signal to apply the sample bottles to the freeze dryer. The device maintains the operating conditions indefinitely waiting for receipt of the sample bottles. After the sample bottles are applied to the device, the controller determines that the pressure and temperature have returned to desired levels and actuates an alarm if they have not.

Upon completion of the freeze drying process or upon the condenser carrying a maximum amount of ice, the operator can press one button to start the defrost cycle. The controller then runs through the defrost sequence and performs a test to ascertain if the condenser is free of ice. This test involves heating the condenser to a temperature of +40 degrees Centigrade and timing out for three minutes. If the temperature sensed on the condensor falls down to +34 degrees Centigrade, then the controller determines that the condenser still carries ice and the refrigeration system returns to heating the condenser. When the sensed temperature remains above +34 Centigrade degrees after the three minute period the ice has all been melted and the refrigeration system turns off. This again allows the operator to leave the device for attended operation with the device turning itself off after completing its assigned operation. The automatic turn off feature saves needless wear on the compressor of the refrigeration system and also saves the cost of electricity otherwise needed to power the device while it continues operation long after the ice has melted.

During operation the device may experience a power outage. When power returns to the device and the device is set in the operating mode, the controller senses the temperature to ascertain if it is at or below −30 degrees Centigrade. The controller also senses the pressure to determine if it is at or below 3000 millitorr. If both these conditions are satisfied, the controller determines that the samples remain frozen and their integrity is safe, and continues with the lyophilization procedure. If one or both of these conditions are exceeded, then the device leaves its set operating mode to remove the refrigeration and low pressure and actuates an audible and visible alarm. The device maintains the integrity of the samples, in the latter case, by allowing them to remain or become melted while still attached to the device. The researcher later can re-freeze the samples and continue with the drying process.

In all of these cases, the invention frees the operator to perform other productive activities until the device needs the specific attention of the operator. The device of the invention also furnishes better protection for the samples than previously was available with manual control. All this provides for more efficient operation and lower cost to a researcher, who often works on a fixed budget dictated by the limits of his o her grant.

BRIEF DESCRIPTION OF THE DRAWINGS

FIG. 7 is a flow chart of the steps performed by the controller in restarting the device after a power outage.

DESCRIPTION OF THE PREFERRED EMBODIMENT

Figure 1:
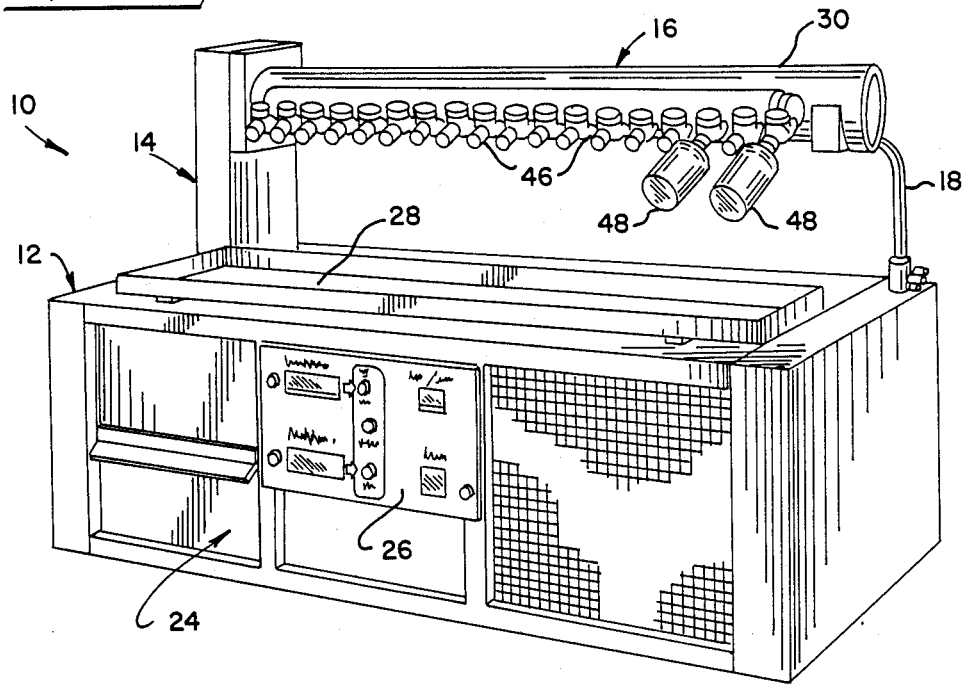
FIG. 1 is a perspective view of a freeze drying device of the invention.
Figure 2:
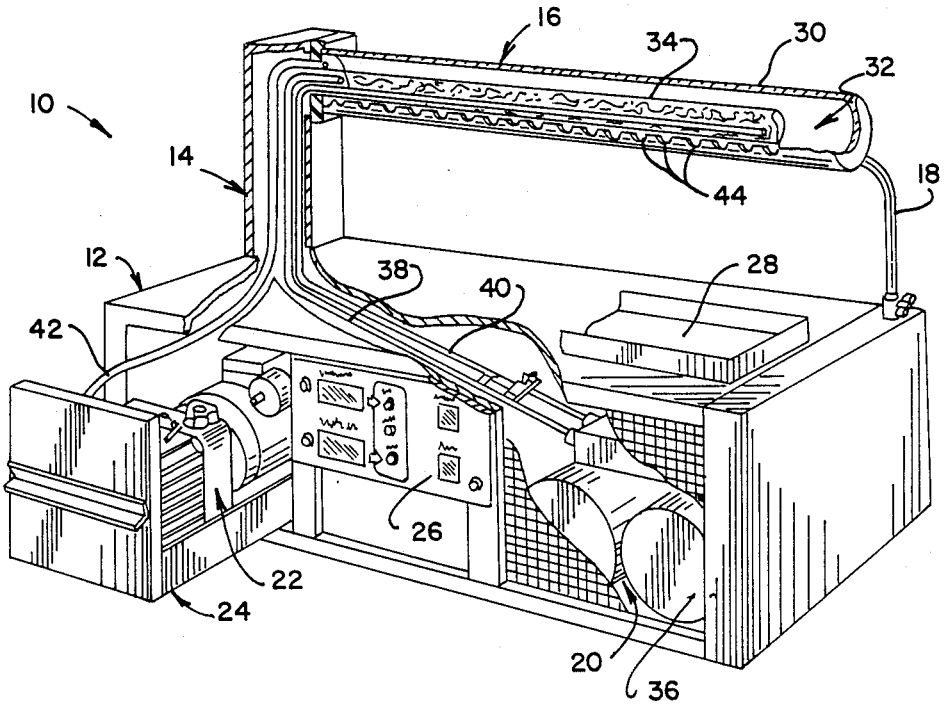
FIG. 2 is a perspective view of the device of the invention in partial section and with the pump system drawer opened.

In FIGS. 1 and 2, the drying device 10 of the invention comprises a cabinet 12, an upstanding tower 14 and a cantilevered manifold 16 supported at the far end by a post assembly 18. Cabinet 12 encloses a mechanical refrigeration system 20 and a vacuum pump system 22, which pump system is contained in a pull-out drawer 24 to facilitate servicing thereof. Cabinet 12 also carries a control panel 26 and a condensate drip pan 28.

With the exception of the control panel 26 and internal control, the freeze drying device of this invention is substantially similar to that disclosed and claimed in U.S. Pat. No. 4,017,983.

Manifold 16 comprises an elongate tube or housing 30 sealed at both ends and forming an interior chamber 32. Inside chamber 32, refrigeration system 20 furnishes an elongate condenser 34 used to condense water vapor in the manifold for effecting the freeze drying or lyophilization process. The condenser 34 becomes connected with the compressor 36 in the cabinet 12 through a supply line 38 and a return line 40. The interior chamber 32 of manifold 16 becomes evacuated or lowered in pressure by vacuum pump system 22 removing gases therefrom through vacuum line 42. Upstanding tower 14 supports one end of the manifold and contains the refrigeration system supply and return lines 38 and 40 and the vacuum line 42.

Figure 3:
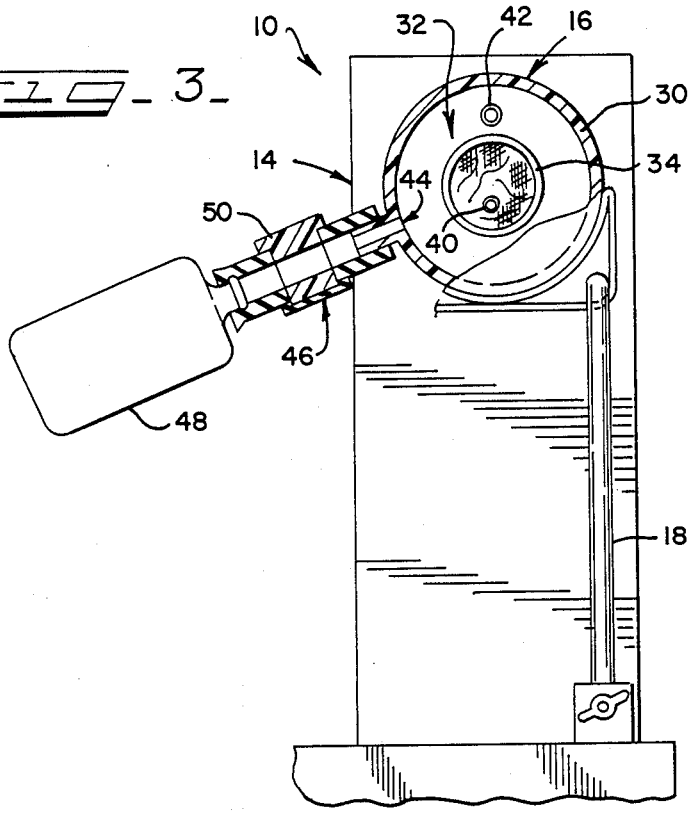
FIG. 3 is a partial sectional view of the device of the invention through the diameter of the horizontal manifold.

Also referring to FIG. 3, the manifold 16 furnishes a plurality of ports 44 at which sample products to be freeze dried can be connected to the freeze drying device 10. Each port carries a manually operable valve 46 such as that disclosed and claimed in U.S. Pat. No. 3,945,603, and each valve can carry a bottle 48, such as that disclosed in U.S. Pat. No. 4,084,330 for containing frozen sample product to be freeze dried. This arrangement of sample bottle 48, valve 46, port 44 and manifold 16 presents an efficient structure for effecting the freeze drying process as was described in the referenced U.S. Pat. No. 4,017,938. In FIG. 3, the valve stem 50 stands open to provide direct gaseous communication between the interior of bottle 48 and the interior chamber 32 of manifold 16. Before an operator removes a bottles 48 from the valve 46, he or she will rotate the valve stem 50 to close the valve and block entrance of room gases into the interior chamber 32.

Figure 4:
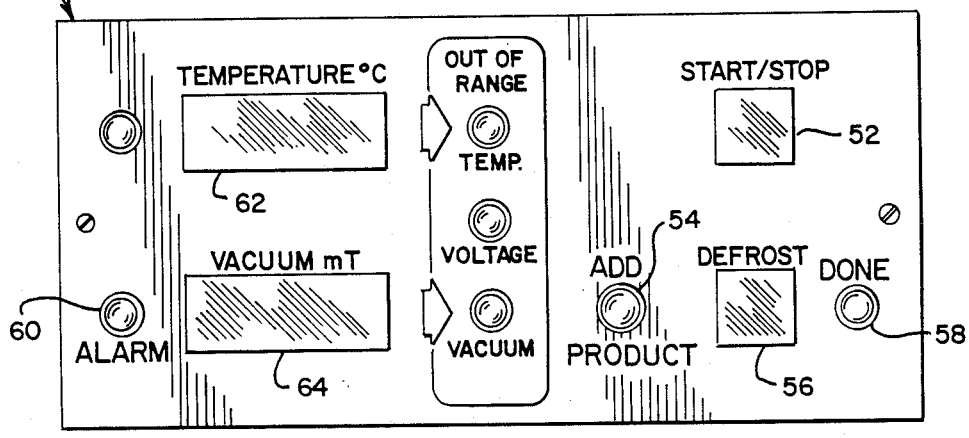
FIG. 4 is a front elevational view of the face plate of the controller of the invention.
Figure 8:
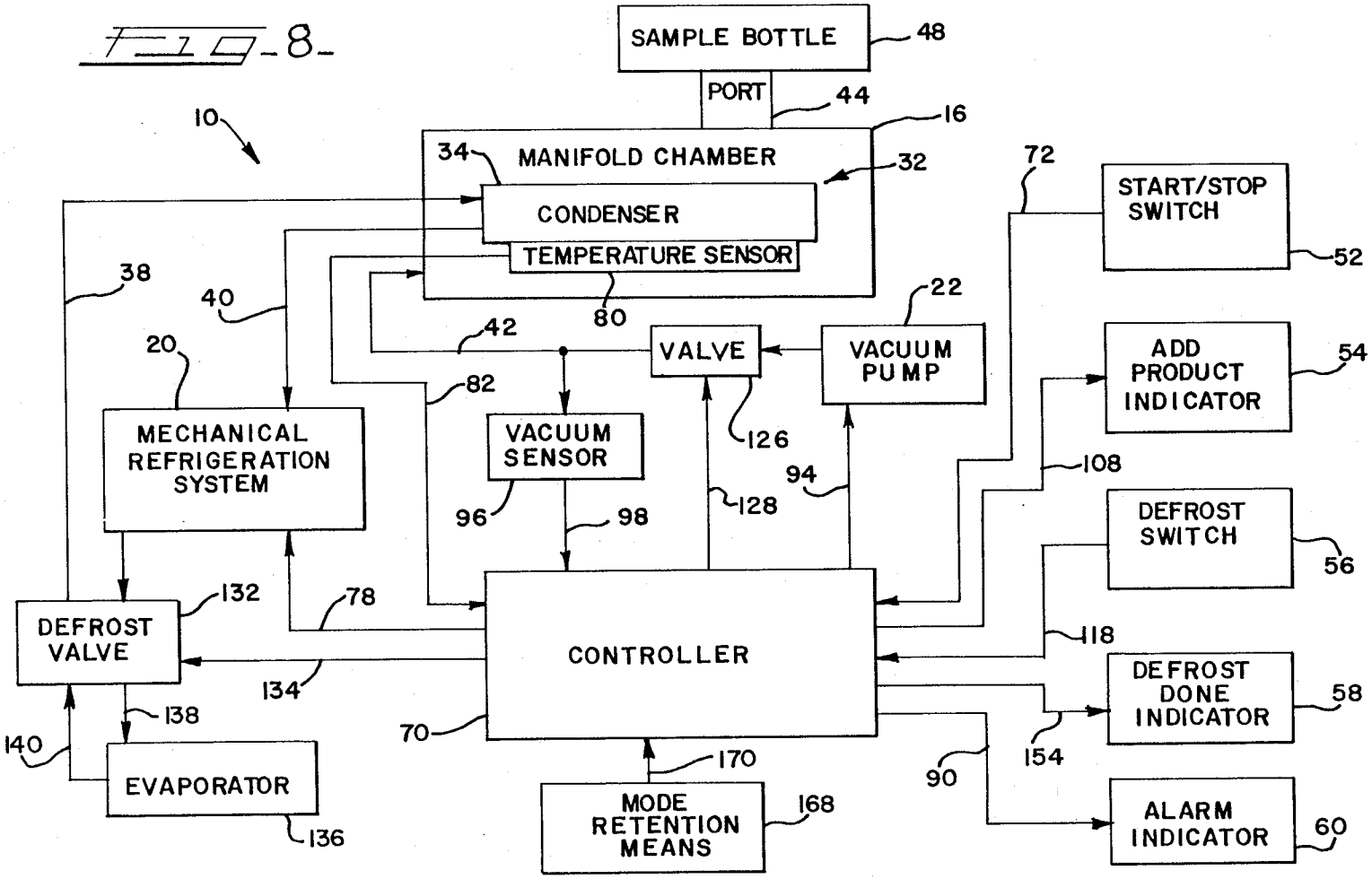
FIG. 8 is a block diagram of the device of the invention.

Referring to FIGS. 4 and 8, control panel 26 comprises an array of indicators and operator actuatable switches. Depressing a start-stop switch 52 starts the operation of the freeze drying device to come to a normal operation mode. When the device attains that normal operation mode, it energizes a light 54 indicating that the operator should add product to the device, such product being contained frozen in sample bottles 48 that are to be connected to the valves 46 extending from the manifold 16.

When the condenser has accumulated a maximum desired amount of ice from the sample product, the operator can press the defrost switch 56 to set the device into a defrost mode of operation. When the defrosting operation becomes completed, the device can de-energize a light 58 to signal the operator that the defrosting mode has finished. The control panel 26 also furnishes an opening 60 that supplies an audible tone to indicate that the device is in an alarm condition requiring the personal attention of the operator. The panel further furnishes digital indications of the temperature at display 62 and of the vacuum pressure at display 64 and can energize out-of-range indicator lights as may be desired.

Referring to FIG. 8, the freeze drying device 10 further includes a controller 70 constructed and arranged to furnish unattended operation of the device after an operator has indicated the function to be effected by actuating the desired switch. In the preferred embodiment, the processor 70 comprises any commercially available microprocessor and software programming to effect the logical steps to be described herein. Of course, the controller 70 can be also a hardwired device using electronic or electrical components to effect the process steps to be described.

Figure 5:
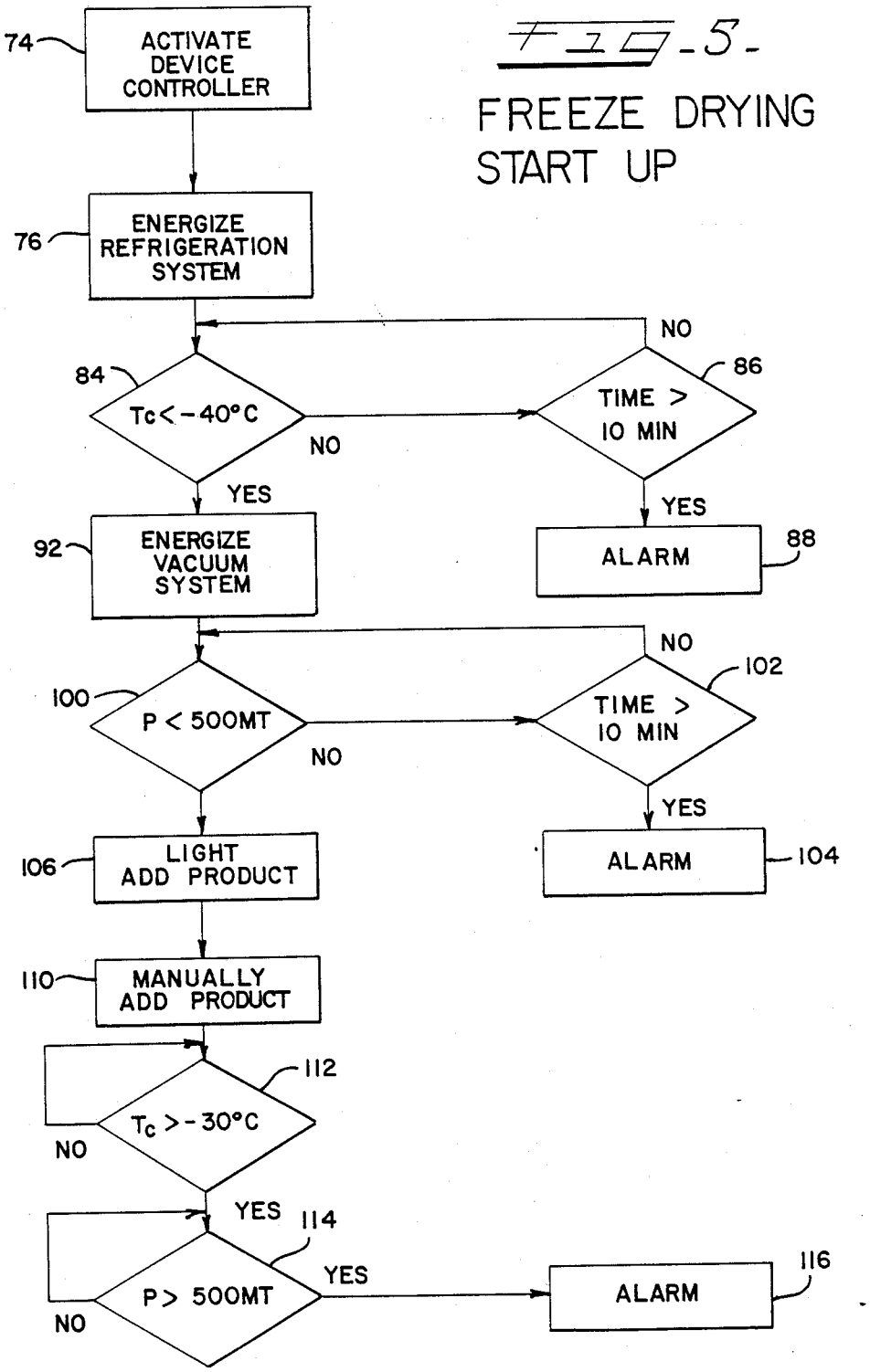
FIG. 5 is a flow chart of the steps performed by the controller in conditioning the device to accept samples.

Also referring to FIG. 5, an operator commences the freeze drying start-up sequence by depressing the start-stop switch 52 connected to controller 70 by lead 72. This effects the step 74 in FIG. 5 of activating the device controller. Thereafter, the controller effects step 76 of energizing refrigeration system 20 by producing an energize signal on lead 78 thereto. The mechanical refrigeration system 20 proceeds to begin cooling the condenser 34 and a temperature sensor 80 indicates the temperature in the manifold chamber 32 over a lead 82 to the controller 70. Controller 70 proceeds to check the indicated temperature in decision step 84. If the temperature $T_c$ at the sensor 80 is not below −40° C., the controller 70 proceeds to decision step 86 to determine if the time since the temperature sensing began is greater than 10 minutes. If the time is greater than 10 minutes, the controller 70 proceeds to an alarm state indicated by block 88 in which such as alarm indicator 60 can be activated over indicator lead 90. If the time since the temperature sensing began remains less than 10 minutes, the controller returns to decision block 84 again to check the temperature.

When the temperature in the manifold chamber 32 becomes less than −40° C. in less than 10 minutes, the controller 70 proceeds to step 92 to energize the vacuum system by producing an energize or activate signal on lead 94 to vacuum pump 22. A vacuum sensor 96 indicates the gaseous pressure remaining inside the manifold chamber 32 and conveys this pressure or vacuum reading to controller 70 over lead 98. Vacuum sensor 96 stands in gaseous communication with the interior of manifold chamber 32 by way of vacuum line 42. Controller 70 then proceeds to check the pressure for a period of 10 minutes as is indicated by flow chart decision blocks 100 and 102 in a manner similar to that used to check the temperature. Again, if the pressure does not go below 500 millitorr in more than 10 minutes, the controller enters an alarm state indicated by block 104. When the pressure falls below 500 millitorr, the controller proceeds to step 106 to light the add-product indicator 54 via indicator lead 108. This signals to the operator that the drying device has achieved operational freeze drying low temperature and low pressure and that the device stands ready to receive sample product to be freeze dried.

Upon recognizing the add-product indicator being lit, the operator proceeds as indicated by step 110 manually to add product to the device in the form of sample product contained frozen in sample bottles 48 being connected through valves 46 to the manifold chamber 32. After the operator manually adds product to the device 10, controller 70 proceeds through two decision blocks 112 and 114 respectively to check to see if the temperature rises above −30° C.; and if the pressure rises above 500 millitorr and if both of the conditions occur during a freeze drying operation, controller 70 proceeds to place the device 10 in an alarm state indicated by block 116. In alarm states indicated by block 116, 104 and 88, the device 10 not only activates the alarm indicator 60 over lead 90 but also can act to de-energize or deactivate either or both of the refrigeration system 20 and vacuum system 22 to protect the integrity of the sample product, as may be desired.

The controller 70 thus receives only a start indication from the start-stop switch 52 actuated by the operator and proceeds to place the device 10 in an operable state for effecting a freeze drying or a lyophilization procedure. When the device 10 achieves the desired conditions, the controller operates to actuate the add-product indicator to the operator. If the device does not achieve the desired operating conditions, the controller 70 automatically, and without operator intervention, indicates an alarm condition and proceeds to protect the device as may be desired. The controller 70 will maintain the device 10 idling in the state indicated by block 106 after the controller has lit the add-product indicator. After the operator manually adds product, the operator can again walk away to let the device 10 operate normally in effecting the freeze drying or lyophilization procedure. In this operating mode, the controller 70 continuously monitors both the temperature and pressure, and if they rise above a certain temperature and a certain pressure, the controller 70 proceeds to an alarm condition indicated by block 116 to protect the device and the integrity of the sample product. This achieves an unattended operation of the device 10 for effecting the freeze drying procedure while signalling the operator that attention may be required.

Figure 6:
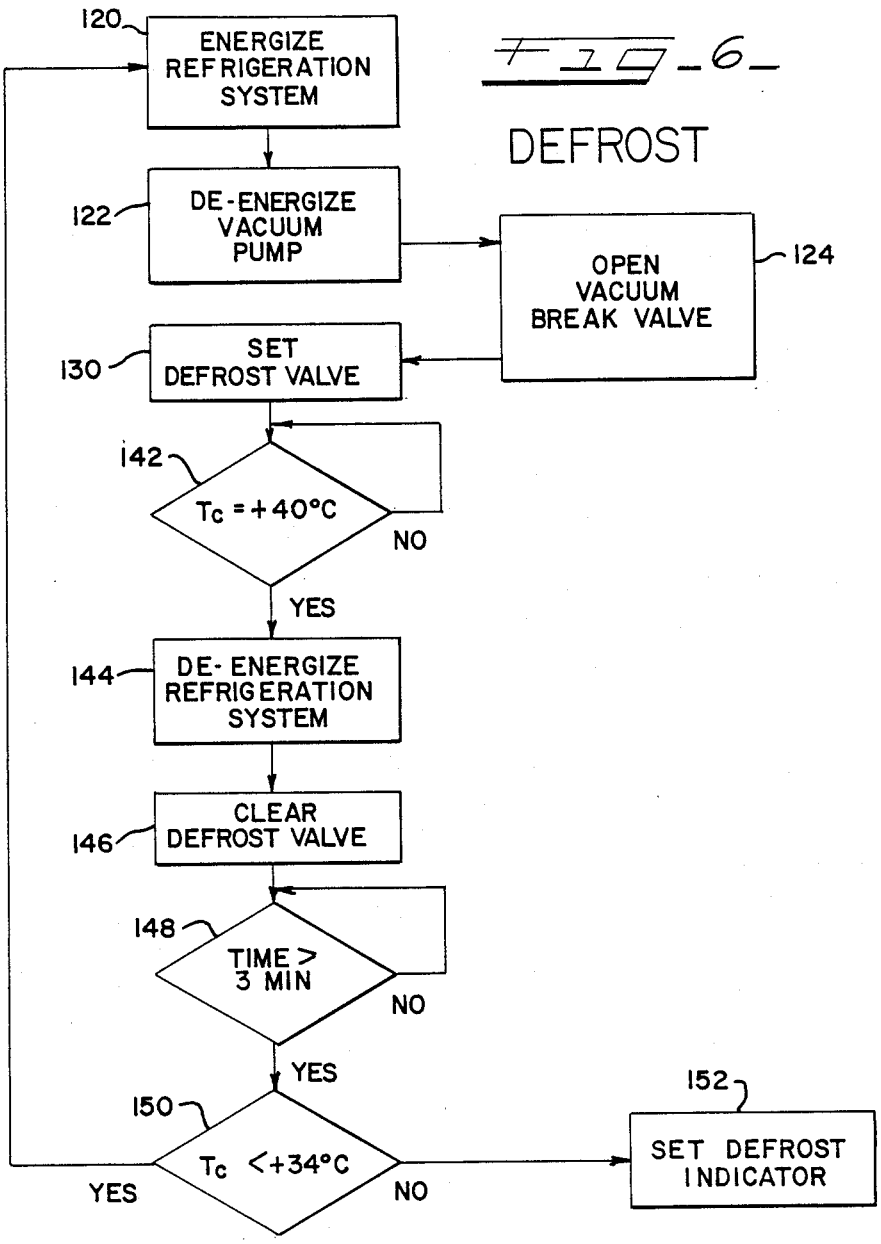
FIG. 6 is a flow chart of the steps performed by the controller in defrosting the condenser in the manifold.

Referring to FIGS. 8 and 6, the controller 70 also automatically can conduct a defrost operation of the device 10 upon receiving an indication that such a sequence should commence by the operator actuating defrost switch 56, and such actuation being indicated on lead 118. The controller then proceeds to energize the refrigeration system 20, indicated at block 120 or to maintain the refrigeration system energized from the normal operating mode. The refrigeration system becomes or is maintained operated by an energize signal on lead 78. The controller 70 de-energizes, indicated at block 122, the vacuum pump by removing the activate signal on lead 94 thereto. Controller 170 opens, indicated at block 124, the vacuum brake valve 126 by producing an open signal on lead 128. This allows room pressure into the manifold chamber 32 relieving the low pressure formed therein by the vacuum pump 22. Controller 70 then sets, indicated by block 130, the defrost valve 132 by producing a set signal on lead 134. Setting the defrost valve guides hot, compressed gases from the mechanical refrigeration system 20 directly to condenser 38 without the gases passing through evaporator 136 through lines 138 and 140 as those hot gases normally Would do when the refrigeration system becomes arranged to cool the condensor 34. Controller 70 then senses the temperature at the condenser through temperature sensor 80 to determine when it equals +40° C. This indicates that at least a portion of the ice carried on condenser 34 has melted; it has risen. +40° C. degrees above the melting point of water.

When controller 70 senses that the temperature has risen to +40° C., as indicated in blocks 144 and 146, it de-energizes the refrigeration system by removing the energize signal from lead 78 and clears the defrost valve by removing the set signal from lead 134. Controller 70 then proceeds to effect a timing period of three minutes indicated in decision block 148 and thereafter again senses the temperature $T_c$ at the sensor 80. If the temperature $T_c$ remains above +34° C., this indicates that substantially all the ice on the condenser 34 has melted, and the controller proceeds to set the defrost indicator, indicated in block 152 by placing a done signal on lead 154. This completes the defrost cycle and the device awaits further indications from the operator for further operation.

If the controller sees a temperature equal to or less than +34° C., indicated in decision block 150, the controller determines that condenser 34 continues to carry ice, and the controller proceeds again through the process steps of defrosting, indicated by blocks 120–150. This sequence of steps provides for unattended operation of the freeze dryer 10 while effecting the defrost cycle.

The temperatures of +40° C., +34° C. and the three minute time period experimentally were determined to insure complete melting of condensed ice. When all the ice has been melted off the condenser 34, the device 10 turns itself off to prevent undue wear on the mechanical refrigeration system operating for an extended period of time in the defrost mode. This was previously described.

Referring to FIGS. 7 and 8, upon reapplication of electrical power to the freeze drying device 10 after a power outage, controller 70 passes through a power-up step, indicated by block 160, a blank display step represented by block 162 and a brief wait state represented by block 164, to reach a decision point represented by decision block 166. At this decision point, the controller 70 interrogates a mode retention means 168 over a lead 170 to determine the mode of operation that the device 10 was in at the time of the power failure. This mode retention means 168 can be any device desired such a battery-operated portion of memory storing the mode indication data or some mechanical device such as a manually set switch position. In any event, the controller 70 determines whether the device 10 was in a defrost mode, in which case the controller proceeds to a normal defrost mode of operation indicated by block 172, or that the device was idling, in which case the device proceeds to the normal idling mode represented by block 174.

If the device was running when power was removed, controller 70 proceeds to a decision point represented by decision block 176. At that point, the controller determines whether the temperature $T_c$ is less than −30° C. If yes, the controller proceeds to decision block 178. If the pressure inside the manifold chamber 32 is less than 3000 millitorr, then the controller 70 returns the device to normal operation, first by turning on the refrigeration system at block 180, waiting five seconds at block 182, turning on the vacuum system and closing the vacuum valve 126 at block 184 and continuing with normal operation with the alarm blinking at block 186. The device responds to another button being pressed to change the mode by cancelling the blinking alarm indicator 60. This occurs at block 188.

If the temperature in the manifold chamber 32 rises above −30° C. after the power outage, then the controller 70 proceeds to open the vacuum valve 126 at block 190 and proceeds to blank out displays as indicated in block 192. If the controller determines that the temperature is below −30° C. but that the pressure has risen above the 3000 millitorr, then the controller turns on the refrigeration system 20 but opens the valve 126 to allow room pressure into the manifold chamber 32. This is indicated at block 194. Effectively, the controller 70 has determined that although the temperature is below specification, the manifold pressure is above specification. To maintain the integrity of the sample product, the refrigeration system should be energized to keep the condensor ice frozen and the low pressure should be removed by allowing the room pressure into the manifold chamber. Thereafter, the controller also blanks out the displays as indicated at block 192, blinks and beeps alarms such as alarm indicator 60 at block 196 and waits at block 198 for the start/stop button to be pressed, and then controller 70 takes the device to the normal idling mode.

The temperature of −30° C. and the pressure of 3000 millitorr have been experimentally determined to be approximately at the levels at which the device can be reactivated or re-energized after a power outage while maintaining the integrity of the sample products being freeze dried. Above these two limits, operation of the device endangers the integrity of the sample products.

Modifications and variations of the invention are possible in light of the above teachings. It is therefore understood that within the scope of the appended claims the invention may be practiced otherwise than is specifically described.

For example, the word "bottle" is used to include or describe any suitable pressure container made of glass, plastic or metal and of any desired configuration. Further, the invention can be used to advantage in freeze-drying devices other than the manifold type disclosed in this application. The particular temperatures expressed in this description of the invention can be changed as desired. The defrosting, however, must occur above room ambient temperature for the sensed temperatures to drop to indicate the continued presence of ice on the condensor after the reverse operation of the refrigeration system. Defrosting above room temperature always causes the sensed temperatures to drop; operating below room temperatures can cause them to rise even when ice remains on the condenser.

I claim:

1. A process of freeze drying a product contained in a bottle with a freeze dryer device that furnishes a freeze drying manifold presenting a sealed interior chamber, a refrigeration system including a condenser in said manifold for collecting condensable vapors in said interior chamber, a vacuum pump system for reducing the ambient pressure in said interior chamber and said manifold presenting at least one port adapted to receive said bottle and selectively to place the interior of said bottle and product in gaseous communication with said interior chamber, said product being frozen in said bottle, said process comprising:

A. activating a device controller automatically to prepare said freeze dryer device for properly receiving at least one bottle containing a frozen product;

B. using said device controller automatically to energize said refrigeration system while using said device controller automatically to maintain said vacuum pump quiescent;

C. measuring the temperature of said condenser in said manifold with said device controller by leads extending from said device controller to said condenser;

D. using said device controller automatically to energize said vacuum pump for simultaneous operation with said refrigeration system only after said device controller measures a desired reduced temperature at said condenser;

E. measuring the pressure in said sealed interior chamber with said device controller by leads extending from said device controller;

F. activating a user recognizable indicator upon said device controller measuring a desired reduced pressure in said interior chamber with a maintenance of said desired reduced temperature at said condenser;

G. automatically maintaining, with said device controller, at least said desired reduced temperature at said condenser and said desired reduced pressure in said interior chamber; and H. connecting said at least one bottle to said at least one port for effecting gaseous communication between said product and said interior chamber, so that said desired reduced temperature and pressure can effect said freeze drying of said product.

2. The process of claim 1 in which said desired reduced temperature at said condensor is substantially minus 40 degrees centigrade.

3. The process of claim 1 in which said desired reduced temperature in said chamber is substantially 500 millitorr.

4. A process of defrosting a condenser of a refrigeration system in a freeze drying device that furnishes a freeze drying manifold presenting a sealed interior chamber with said condensor arranged in said manifold to collect condensable vapors in said chamber, said device including a vacuum pump system for reducing the ambient pressure in said interior chamber and said manifold presenting at least one port adapted to receive a sample bottle containing a product to be freeze dried selectively to place the interior of said bottle and product in gaseous communication with said interior chamber, said product being frozen in said bottle, said process comprising:

A. operating said refrigeration system in a reverse defrost mode to increase the temperature of said condenser while opening said interior chamber to the atmosphere;

B. sensing the temperature of said condenser while operating said refrigeration system in reverse mode;

C. de-energizing said refrigeration system upon the temperature at said condenser rising to a first certain temperature;

D. starting a timer having a fixed period after de-energizing said refrigeration system;

E. sensing the temperature of said condenser at the end of said fixed period;

F. repeating steps A–E when the sensed temperature at the end of said fixed period becomes less than a second certain temperature; and G. maintaining said refrigeration system de-energized, returning same to a normal cooling mode and activating a user recognizable indicator when the sensed temperature at the end of said fixed period equals or exceeds said second certain temperature.

5. The process of claim 4 in which said first certain temperature is substantially plus 40 degrees centigrade.

6. The process of claim 5 in which said second certain temperature is substantially plus 34 degrees centigrade.

7. The process of claim 4 in which said period is substantially three minutes.

8. A process of maintaining the integrity of a sample product in an operating freeze drying device upon occurrence of an electrical power failure, the freeze drying device including a manifold containing a sealed interior chamber, a refrigeration system including a condenser in said manifold for collecting condensable vapors in said interior chamber, a vacuum pump system for reducing the ambient pressure in said interior chamber and said manifold presenting at least one port adapted to receive a sample bottle containing said sample product selectively to place the interior of said bottle and product in gaseous communication with said interior chamber, said product being frozen in said bottle, said process comprising:

A. detecting that an electrical power failure occurred at said device while said device was operating to freeze dry product frozen in said at least one bottle;

B. sensing the temperature at said condenser and the ambient pressure in said interior chamber after electrical power becomes restored to said freeze drying device;

C. re-energizing said refrigeration system and said vacuum pump system for continuing said freeze drying operation upon said sensed temperature being no greater than a first certain value and said sensed pressure being no greater than a second certain value; and D. de-energizing said refrigeration system and said vacuum pump system and activating a user recognizable indicator for interrupting said freeze drying operation upon either one of said sensed temperature exceeding said first certain value and said sensed pressure exceeding said second certain value.

9. The process of claim 8 in which said first certain value is substantially minus 30 degrees centigrade.

10. The process of claim 8 in which said second certain value is substantially 3000 millitorr.

11. A freeze drying device for defrosting condensed vapors sublimated from sample product adapted to be brought into gaseous communication with said device and contained in a frozen state in at least one sample bottle, said device comprising:

A. a manifold presenting a sealed interior chamber and presenting at least one port adapted to receive said at least one bottle selectively to place the interior of said bottle and the contained frozen sample product in gaseous communication with said interior chamber;

B. refrigeration means normally for removing heat from said interior chamber, said refrigeration means including a condenser contained in said interior chamber of said manifold that collects said condensed vapors sublimated from said sample product, and a defrost valve that becomes set to guide hot gases in said refrigeration means to said condenser in response to receiving a set signal on a set control lead and said refrigeration means becoming energized in response to receiving an energize signal on a first control lead;

C. vacuum means communicating with said interior chamber normally for reducing the ambient pressure in said interior chamber, said vacuum means including a break valve that opens to allow room pressure into said chamber in response to receiving an open signal on an open control lead and said vacuum means becoming de-activated in response to removal of an activate signal on a second control lead;

D. temperature sensor means connected to said condenser and producing an electrical temperature signal indicating the temperature of said condenser on a first indicator lead;

E. user actuatable defrost switch means for producing an electrical defrost start signal on a third control lead in response to a user actuating said switch means to start defrost operation of said device;

F. user recognizable defrost indicator means for producing a user recognizable defrost finished signal in response to receiving an electrical done signal on a third indicator lead; and G. control means connected to said control and indicator leads, upon receiving said defrost start signal, said control means for sequentially removing said activate signal to de-activate said vacuum means, producing said open signal to bring said chamber to room pressure and producing said set signal to direct hot gases to said condenser while maintaining said refrigeration means operating, said controller means thereafter sensing when said condenser temperature attains a temperature of a first certain value that is above freezing and then removing said energize signal to de-energize said refrigeration means, removing said set signal to clear said defrost valve, timing for a certain period and sensing a second temperature of the condenser, said control means sensing said second temperature of a second value causing said control means to repeat its operation in a manner the same as receiving said defrost start signal and said control means sensing a second temperature above said second certain value causing said control means to produce said done signal.

12. The device of claim 11 in which said first certain value is substantially plus 40 degrees centigrade.

13. The device of claim 11 in which said second certain value is substantially plus 34 degrees centigrade.

14. The device of claim 11 in which said certain period is substantially three minutes.

15. A freeze drying device for freeze drying a sample product adapted to be contained in a frozen state in at least one bottle, said device comprising:

A. a manifold presenting a sealed interior chamber and presenting at least one port adapted to receive said at least one bottle, selectively to place the interior of said bottle and the contained frozen sample product in gaseous communication with said interior chamber;

B. refrigeration means including a condenser in said interior chamber of said manifold for condensing condensable vapors in said interior chamber, said refrigeration means becoming energized to cool said condenser in response to receiving an energize signal on a first control lead;

C. vacuum means communicating with said interior chamber for reducing the ambient pressure in said interior chamber, said vacuum means becoming activated to reduce said pressure in response to receiving an activate signal on a second control lead;

D. temperature sensor means connected to said condenser and producing an electrical temperature signal indicating th temperature of said condenser on a first indicator lead;

E. pressure sensor means communicating with said interior chamber and producing an electrical pressure signal indicating the pressure in said chamber on a second indicator lead;

F. user actuatable start switch means for producing an electrical process start signal on a third control lead in response to a user actuating said switch means to start operation of said device;

G. user recognizable indicator means for producing a user recognizable apply samples signal in response to receiving an electrical ready signal on a third indicator lead; and H. control means connected to said first, second and third control and indicator leads, upon receiving said process start signal, said control means for producing said energize signal to energize said refrigeration means while maintaining said pressure means quiescent until a certain low temperature has been indicated by said temperature signal and then producing said activate signal to activate said pressure means to reduce the pressure in said interior chamber, and upon said pressure signal indicating a certain low pressure in said chamber said controller means producing said ready signal to indicate to said user that the device stands ready to receive at least one bottle containing a frozen sample for effecting a freeze drying process thereon.

16. The device of claim 15 in which said certain temperature is substantially minus 40 degrees centigrade.

17. The device of claim 15 in which said certain pressure is substantially 500 millitorr.

18. A freeze drying device for maintaining the integrity of a sample product adapted to be contained in a frozen state in at least one bottle connected to said device while said device recovers from an electrical power failure, said device comprising:

A. a manifold presenting a sealed interior chamber and presenting at least one port adapted to receive said at least one bottle, selectively to place the interior of said bottle and the contained frozen sample product in gaseous communication with said interior chamber;

B. refrigeration means including a condenser in said interior chamber of said manifold for condensing condensable vapors in said interior chamber, said refrigeration means becoming energized to cool said condenser in response to receiving an energize signal on a first control lead;

C. vacuum means communicating with said interior chamber for reducing the ambient pressure in said interior chamber, said vacuum means becoming activated to reduce said pressure in response to receiving an activate signal on a second control lead;

D. temperature sensor means connected to said condenser and producing an electrical temperature signal indicating the temperature of said condenser on a first indicator lead;

E. pressure sensor means communicating with said interior chamber and producing an electrical pressure signal indicating the pressure in said chamber on a second indicator lead;

F. mode retention means for indicating on a mode indicator lead after return of the electrical power the mode in which said device was operating at the time of said power failure;

G. user recognizable indicator means for producing a user recognizable alarm signal in response to receiving an electrical alarm signal on a third indicator lead; and H. control means connected to said control and indicator leads, upon return of said electrical power, said control means for sensing that said device was in an operating mode and thereafter sensing the temperature and pressure in said chamber, said control means then causing said device to return to said operating mode upon said chamber temperature being less than a certain temperature and said chamber pressure being less than a certain pressure by producing said energize and activate signals and said control means causing said device to enter an alarm mode upon either of said chamber temperature or pressure being equal to or greater than said respective certain temperature and pressure, removing any energize and activate signals and producing said alarm signal on said third indicator lead.

19. The device of claim 18 in which said certain temperature is substantially minus 30 degrees centigrade.

20. The device of claim 18 in which said certain pressure is substantially 3000 millitorr.

21. A process of freeze-drying a product contained in a bottle with a freeze dryer device that furnishes a freeze drying manifold presenting a sealed interior chamber, a refrigeration system including a condenser in said manifold for condensing condensable vapors in said interior chamber, a vacuum pump system for reducing the ambient pressure in said interior chamber and said manifold presenting at least one port adapted to receive said bottle and selectively to place the interior of said bottle and product in gaseous communication with said interior chamber, said product being frozen in said bottle, said process comprising:

A. preparing the device for effecting the freeze drying after receiving a user produced signal by operating the refrigeration system while maintaining the pump system quiescent until the temperature of the condenser attains a first value and then operating the pump system to produce a low pressure of a second value in said chamber, upon the low pressure of said second value becoming attained then producing a user recognizable indication;

B. receiving said bottle containing said sample product and continuing operation of said refrigeration and pump systems;

C. condensing water in a frozen state on said condenser to dry said sample product;

D. defrosting said condensor to remove said frozen water therefrom by opening said chamber to room pressure and reversing operation of said refrigeration system to heat said condenser, thereafter de-energizing the refrigeration system upon the temperature of said condensor attaining a third value, said defrosting also including timing for a period after de-energizing the refrigeration system and sensing a second temperature at said condenser with a second temperature above a fourth value concluding said defrosting and a second temperature at said fourth value re-operating said refrigeration system; and E. maintaining the integrity of said sample upon a power outage by sensing the temperature of said condenser and the pressure in said chamber and returning to normal operation of said freeze drying upon the temperature being less than a fifth value and the pressure being less than a sixth value and terminating the freeze drying process upon either the temperature being greater than said fifth value or said pressure being greater than said sixth value.

22. The process of claim 21 in which said first value is substantially minus 40 degrees centigrade.

23. The process of claim 21 in which said second value is substantially 500 millitorr.

24. The process of claim 21 in which said third value is substantially plus 40 degrees centigrade.

25. The process of claim 21 in which said fourth value is substantially plus 34 degrees centigrade.

26. The process of claim 21 in which said fifth value is substantially minus 30 degrees centigrade.

27. The process of claim 21 in which said sixth value is substantially 3000 millitorr.

28. A freeze drying device for freeze drying a sample product adapted to be contained in a frozen state in at least one bottle, said device comprising:

a manifold presenting a sealed interior chamber and presenting at least one port adapted to receive said at least one bottle, selectively to place the interior of said bottle and the contained frozen sample product in gaseous communication with said interior chamber;

B. refrigeration means including a condenser in said interior chamber of said manifold for condensing condensable vapors in said interior chamber, said refrigeration means becoming energized to cool said condenser in response to receiving an energize signal on a first control lead;

C. vacuum means communicating with said interior chamber for reducing the ambient pressure in said interior chamber, said vacuum means becoming activated to reduce said pressure in response to receiving an activate signal on a second control lead;

D. temperature sensor means connected to said condenser and producing an electrical temperature signal indicating the temperature of said condenser on a first indicator lead;

E. pressure sensor means communicating with said interior chamber and producing an electrical pressure signal indicating the pressure in said chamber on a second indicator lead;

F. operational control means for preparing the device for effecting the freeze drying after receiving a user produced signal by operating the refrigeration system while maintaining the pump system quiescent until the temperature of the condenser attains a first value and then operating the pump system to produce a low pressure of a second value in said chamber, upon the low pressure of said second value becoming attained then producing a user recognizable indication;

G. defrost control means for defrosting said condensor to remove frozen water condensed thereon during operation of said device in a freeze drying procedure, said defrost control means effecting said defrosting by opening said chamber to room pressure and reversing operation of said refrigeration system to heat said condenser, thereafter de-energizing the refrigeration system upon the temperature of said condensor attaining a third value, said defrosting also including timing for a period after de-energizing the refrigeration system and sensing a second temperature at said condenser with a second temperature above a fourth value concluding said defrosting and a second temperature at said fourth value re-operating said refrigeration system; and H. power outage control means for maintaining the integrity of said sample upon a power outage by sensing the temperature of said condenser and the pressure in said chamber and returning to normal operation of said freeze drying upon the temperature being less than a fifth value and the pressure being less than a sixth value and terminating the freeze drying process upon either the temperature being greater than said fifth value or said pressure being greater than said sixth value.

29. The device of claim 28 in which said first value is substantially minus 40 degrees centigrade.

30. The device of claim 28 in which said second value is substantially 500 millitorr.

31. The device of claim 28 in which said third value is substantially plus 40 degrees centigrade.

32. The device of claim 28 in which said fourth value is substantially plus 34 degrees centigrade.

33. The device of claim 28 in which said fifth value is substantially minus 30 degrees centigrade.

34. The device of claim 28 in which said sixth value is substantially 3000 millitorr.

35. A process of defrosting a condenser of a refrigeration system in a freeze drying device, said device including a chamber adapted to be placed at least in gaseous communication with product to be freeze dried, said condenser for collecting condensable vapors sublimated from said product, and said device including a vacuum pump system for reducing the ambient pressure in said chamber, said process comprising:

A. automatically operating said refrigeration system in a reverse defrost mode to increase the temperature of said condenser while opening said chamber to the atmosphere;

B. sensing the temperature of said condenser with a temperature sensor;

C. automatically de energizing said refrigeration system upon the temperature at said condenser rising to a first certain temperature;

D. starting a timer having a fixed period after de-energizing said mechanical refrigeration system;

E. sensing the temperature of said condenser with said sensor at the end of said fixed period;

F. repeating steps A–E when the sensed temperature at the end of said fixed period becomes less than a second certain temperature; and G. maintaining said refrigeration system de energized, returning same to a normal cooling mode and activating a user recognizable indicator when the sensed temperature at the end of said fixed period equals or exceeds said second certain temperature.

36. The process of claim 35 in which said first certain temperature is substantially plus 40 degrees centigrade.

37. The process of claim 36 in which said second certain temperature is substantially plus 34 degrees centigrade.

38. The process of claim 35 in which said period is substantially three minutes.

39. A process of maintaining the integrity of a sample product in an operating freeze drying device upon occurrence of an electrical power failure, said device including a chamber adapted to be placed at least in gaseous communication with product to be freeze dried, a refrigeration system including a condenser for collecting condensable vapors sublimated from said product, and a vacuum pump system for reducing the ambient pressure in said chamber, said process comprising:

A. detecting that an electrical power failure occurred at said device while said device was operating to freeze dry said product;

B. sensing the temperature at said condenser and the ambient pressure in said chamber after electrical power becomes restored to said freeze drying device;

C. re-energizing said refrigeration system and said vacuum pump system for continuing said freeze drying operation upon said sensed temperature being no greater than a first certain value and said sensed pressure being no greater than a second certain value; and D. de-energizing said refrigeration system and said vacuum pump system and activating a user recognizable indicator for interrupting said freeze drying operation upon either one of said sensed temperature exceeding said first certain value and said sensed pressure exceeding said second certain value.

40. The process of claim 39 in which said first certain value is substantially minus 30 degrees centigrade.

41. The process of claim 39 in which said second certain value is substantially 3000 millitorr.

42. A freeze drying device for defrosting condensed vapors sublimated from sample product adapted to be brought into gaseous communication with said device, said device having a chamber adapted to be placed in gaseous communication with said product, a refrigeration system including a condenser for collecting condensable vapors sublimated from said product, and a vacuum pump system for reducing the ambient pressure in said chamber, said device comprising:

A. means for operating said refrigeration system in a reverse mode to increase the temperature of said condenser while opening said chamber to the atmosphere;

B. means for sensing the temperature of said condenser;

C. means for de-energizing said refrigeration system upon the temperature at said condenser rising to a first certain temperature hen said refrigeration system operates in a reverse mode;

D. means for starting a timer having a fixed period after de-energizing said mechanical refrigeration system; and E. means for re-operating said refrigeration system in a reverse mode when the temperature of said condenser at the end of said fixed period becomes less than a second certain temperature, and maintaining said refrigeration system de-energized and returning same to a normal cooling mode when the temperature of said condenser at the end of said fixed period equals or exceeds said second certain temperature.

43. The device of claim 42 in which said first certain value is substantially plus 40 degrees centigrade.

44. The device of claim 43 in which said second certain value is substantially plus 34 degrees centigrade.

45. The device of claim 42 in which said certain period is substantially three minutes.

46. A freeze drying device for maintaining the integrity of a sample product adapted to be freeze dried in said device while said device recovers from an electrical power failure, said device having a chamber adapted to be placed in gaseous communication with said product, a refrigeration system including a condenser for collecting condensable vapors sublimated from said product, and a vacuum pump system for reducing the ambient pressure in said chamber, said device comprising:

A. means for detecting that an electrical power failure occurred at said device while said device was operating to freeze dry said product;

B. means for sensing the temperature at said condenser after electrical power becomes restored to said freeze drying device;

C. means for sensing the ambient pressure in said chamber after electrical power becomes restored to said freeze drying device; and D. means for re energizing said refrigeration system and said vacuum pump system for continuing said freeze drying operation upon said sensed temperature of said condenser being no greater than a first certain value and said sensed pressure in said chamber being no greater than a second certain value, and de energizing said refrigeration system and said vacuum pump system to interrupt said freeze drying operation upon either one of said sensed temperature exceeding said first certain value and said sensed pressure exceeding said second certain value.

47. The device of claim 46 in which said certain temperature is substantially minus 30 degrees centigrade.

48. The device of claim 46 in which said certain pressure is substantially 3000 millitorr.

49. A process of freeze drying a product in a freeze dryer device having a chamber adapted to be in gaseous communication with said product, a refrigeration system including a condenser in gaseous communication with said chamber for collecting condensable vapors given off by said product, and a vacuum pump system for reducing the ambient pressure in said chamber, said process comprising:

A. preparing the device for effecting the freeze drying operation after receiving a user produced signal by operating the refrigeration system while maintaining the pump system quiescent until the temperature of the condenser attains a first value and then operating the pump system to produce a low pressure of a second value in said chamber;

C. collecting condensable vapors in a frozen state on said condenser to dry said sample product;

D. defrosting said condensor to remove said condensed vapors in a frozen state by opening said chamber to room pressure and reversing operation of said refrigeration system to heat said condenser, thereafter de-energizing the refrigeration system upon the temperature of said condensor attaining a third value, said defrosting also including timing for a period after de-energizing the refrigeration system and sensing another temperature at said condenser with said another temperature above a fourth value causing the end of said defrosting and said another temperature at said fourth value causing the re-operating of said refrigeration system in reverse mode; and E. maintaining the integrity of said sample upon a power outage by sensing the temperature of said condenser and the pressure in said chamber and returning to normal operation of said freeze drying upon the temperature being less than a fifth value and the pressure being less than a sixth value and terminating the freeze drying process upon either the temperature being greater than said fifth value or said pressure being greater than said sixth value.

50. The process of claim 49 in which said first value is substantially minus 40 degrees centigrade.

51. The process of claim 49 in which said second value is substantially 500 millitorr.

52. The process of claim 49 in which said third value is substantially plus 40 degrees centigrade.

53. The process of claim 49 in which said fourth value is substantially plus 34 degrees centigrade.

54. The process of claim 49 in which said fifth value is substantially minus 30 degrees centigrade.

55. The process of claim 49 in which said sixth value is substantially 3000 millitorr.

56. A freeze dryer device for freeze drying a product, said device having a chamber adapted to be in gaseous communication with said product, a refrigeration system including a condenser in gaseous communication with said chamber for collecting condensable vapors given off by said product, and a vacuum pump system for reducing the ambient pressure in said chamber, said device comprising:

A. means for preparing the device for effecting the freeze drying operation after receiving a user produced signal by operating the refrigeration system while maintaining the pump system quiescent until the temperature of the condenser attains a first value and then operating the pump system to produce a low pressure of a second value in said chamber;

C. means for collecting condensable vapors in a frozen state on said condenser to dry said sample product;

D. means for defrosting said condensor to remove said condensed vapors in a frozen state by opening said chamber to room pressure, reversing operation of said refrigeration system to heat said condenser, and thereafter de-energizing the refrigeration system upon the temperature of said condensor attaining a third value, said means for defrosting also including means for timing for a period after de-energizing the refrigeration system and sensing another temperature at said condenser with said another temperature above a fourth value causing the end of said defrosting and said another temperature at said fourth value causing again the operation of said refrigeration system in reverse mode; and E. means for maintaining the integrity of said sample upon a power outage by sensing the temperature of said condenser and the pressure in said chamber and returning to normal operation of said freeze drying upon the temperature being less than a fifth value and the pressure being less than a sixth value and terminating the freeze drying process upon either the temperature being greater than said fifth value or said pressure being greater than said sixth value.

57. The device of claim 56 in which said first value is substantially minus 40 degrees centigrade.

58. The device of claim 56 in which said second value is substantially 500 millitorr.

59. The device of claim 56 in which said third value is substantially plus 40 degrees centigrade.

60. The device of claim 56 in which said fourth value is substantially plus 34 degree centigrade.

61. The device of claim 56 in which said fifth value is substantially minus 30 degrees centigrade.

62. The device of claim 56 in which said sixth value is substantially 3000 millitorr.

* * * * *

UNITED STATES PATENT AND TRADEMARK OFFICE

CERTIFICATE OF CORRECTION

PATENT NO. : 4,823,478

DATED : April 25, 1989

INVENTOR(S) : Taylor N. Thompson, Sr.

It is certified that error appears in the above-identified patent and that said Letters Patent is hereby corrected as shown below:

Column 1, line 8, Serial No. "126,227, filed Nov. 30, 1988" should read --126,277, filed Nov. 30, 1987--; line 22, after "such as", insert --are disclosed--; line 62, "condesate" should be --condensate--.

Column 2, line 45, after "furnishes", insert --a--; line 62, after "device", insert --,--; line 62, "walkaway" should be --walk away--.

Column 3, line 49, after "his", delete "o" and insert --or--.

Column 4, line 46, delete "bottles" and insert --bottle--.

Column 6, line 49, delete "170" and insert --70--; line 60, delete "Would" and insert --would--.

Column 7, line 40, after "such", insert --as--.

Column 8, line 46, delete "I claim:" and insert --CLAIMS--.

UNITED STATES PATENT AND TRADEMARK OFFICE

CERTIFICATE OF CORRECTION

PATENT NO. : 4,823,478

DATED : April 25, 1989

INVENTOR(S) : Taylor N. Thompson, Sr.

It is certified that error appears in the above-identified patent and that said Letters Patent is hereby corrected as shown below:

Column 9, line 27, delete "centigrade" and insert --Centigrade--; line 34, delete "condensor" and insert --condenser--; line 68, delete "centigrade" and insert --Centigrade--.

Column 10, line 2, delete "centigrade" and insert --Centigrade--; line 40, delete "centigrade" and insert --Centigrade--.

Column 11, lines 41 and 44, delete "centigrade" and insert --Centigrade--.

Column 12, line 1, after "indicating", delete "th" and insert --the--; line 31, delete "centigrade" and insert --Centigrade--.

Column 13, line 23, delete "centigrade" and insert --Centigrade--; lines 52 and 57, delete "condensor" and insert --condenser--.

Column 14, lines 7, 11, 13, and 15, delete "centigrade" and insert --Centigrade--; line 21, before "a manifold", insert --A.--; lines 58 and 65, delete "condensor" and insert --condenser--.

UNITED STATES PATENT AND TRADEMARK OFFICE

CERTIFICATE OF CORRECTION

PATENT NO. : 4,823,478

DATED : April 25, 1989

INVENTOR(S) : Taylor N. Thompson, Sr.

It is certified that error appears in the above-identified patent and that said Letters Patent is hereby corrected as shown below:

Column 15, line 16, delete "centigrade" and insert --Centigrade--; line 20, delete "centigrade" and insert --Centigrade--; line 22, delete "centigrade" and insert --Centigrade--; line 24, delete "centigrade" and insert --Centigrade--; line 41, delete "de energizing" and insert --de-energizing--; line 51, delete "de energized" and insert --de-energized--; line 58, delete "centigrade" and insert --Centigrade--; line 60, delete "centigrade" and insert --Centigrade--.

Column 16, line 26, delete "centigrade" and insert --Centigrade--; line 46, after "temperature", delete "hen" and insert --when--; line 61, delete "centigrade" and insert --Centigrade--; line 63, delete "centigrade" and insert --Centigrade--.

Column 17, line 17, delete "re energizing" and insert --re-energizing--; line 22, delete "de energizing" and insert --de-energizing--; line 29, delete "centigrade" and insert --Centigrade--; lines 48 and 53, delete "condensor" and insert --condenser--.

UNITED STATES PATENT AND TRADEMARK OFFICE

CERTIFICATE OF CORRECTION

PATENT NO. : 4,823,478

DATED : April 25, 1989

INVENTOR(S) : Taylor N. Thompson, Sr.

It is certified that error appears in the above-identified patent and that said Letters Patent is hereby corrected as shown below:

Column 18, lines 4, 8, 10 and 12, delete "centigrade" and insert --Centigrade--; lines 33 and 38, delete "condensor" and insert --condenser--; lines 57, 61, 63, and 65, delete "centigrade" and insert --Centigrade--.

Signed and Sealed this

Second Day of January, 1990

*Attest:*

JEFFREY M. SAMUELS

*Attesting Officer*

*Acting Commissioner of Patents and Trademarks*